United States Patent [19]

Singer

[11] Patent Number: 4,836,807

[45] Date of Patent: Jun. 6, 1989

[54] SCREW-PLUG-TERMINAL

[75] Inventor: Thomas Singer, Buching, Fed. Rep. of Germany

[73] Assignee: Sft X. Settele Stanz- und Formtechnik GmbH & Co. KG, Buching, Fed. Rep. of Germany

[21] Appl. No.: 147,347

[22] Filed: Jan. 22, 1988

[30] Foreign Application Priority Data

Jan. 23, 1987 [DE] Fed. Rep. of Germany ..... 8701125

[51] Int. Cl.[4] ..... H01R 4/48

[52] U.S. Cl. ..... 439/787; 439/796

[58] Field of Search ..... 439/437–441, 439/786, 787, 796, 788

[56] References Cited

U.S. PATENT DOCUMENTS

| | | | |
|---|---|---|---|
| 2,944,242 | 7/1960 | Bentley | 439/441 |
| 4,133,595 | 1/1979 | Pritulsky | 439/441 |
| 4,172,628 | 10/1979 | Lingaraju | 439/441 |
| 4,332,434 | 6/1982 | Neidecker et al. | 439/787 |

FOREIGN PATENT DOCUMENTS

| | | | |
|---|---|---|---|
| 0052766 | 6/1982 | European Pat. Off. | 439/438 |
| 2344045 | 3/1975 | Fed. Rep. of Germany | 439/438 |

*Primary Examiner*—Gary F. Paumen

*Attorney, Agent, or Firm*—Wenderoth, Lind & Ponack

[57] ABSTRACT

A screw-plug terminal housing is provided having an end with four holes for receiving four connecting leads. The end has two end pieces, sections of the end pieces being angled outwardly from the housing to form a V-shaped configuration. On the inner surface of each section is provided a leaf spring, partially slit in its longitudinal direction, extending toward the interior of the housing. Inside the housing, a free end of each leaf spring clamps a connecting lead against an inside wall of the housing when a connecting lead is inserted into one of the four holes of the end. Slots in the housing allow access to the leaf spring ends to allow simple disconnection of the leads by pushing on the leaf spring to disengage the leaf spring from the lead.

9 Claims, 1 Drawing Sheet

SCREW-PLUG-TERMINAL

BACKGROUND OF THE INVENTION

The invention relates to a screw-plug terminal having a housing into which electrical leads can be inserted and fixed in a desired position by spring tension.

With a two-pole screw-plug terminal it is common practice to attach one leg of a substantially V-shaped leaf spring to an inner wall of a housing, while the other leg of the leaf spring provides clamping engagement with a maximum of two leads. Several of these well-known and technically quite cumbersome arrangements must be used if more than two principal connecting leads are to be connected.

OBJECT OF THE INVENTION

The object of the invention is to provide a screw-plug terminal capable of accomodating at least four leads of equal or unequal capacity, leaf springs being integrated into the housing of the terminal to clamp the leads.

SUMMARY OF THE INVENTION

The above object is achieved in accordance with the invention by providing four holes in one end of a substantially rectangular housing for receiving four principal connecting leads. The housing end has two end pieces, the end pieces having sections angled toward one another in a V-shape. On an inner surface of each section is mounted a leaf spring, partially slit in its longitudinal direction. Between a free end of each leaf spring and an inner wall of the housing is inserted a principal lead, which is thus detachably fixed by clamping engagement of the leaf spring.

The main advantage of this arrangement is the provision of spaces for the insertion of principal leads by the angling of the sections, and the integration of the leaf springs into the housing interior. These springs work independently of one another, so the inserted leads each are effectively held in position inside the screw-plug terminal.

Each leaf spring has a long base leg having a rectangular opening. A butt strap is provided integral with the inner surface of each section to project through the rectangular opening, and is bent against the base leg of each leaf spring. This provides a safe and simple method of fixing the spring within the housing.

Each leaf spring has a free end projecting into the housing which is bent away from the base leg toward an inside wall of the housing. This provides more clamping force for each leaf spring, and allows the leaf spring to take up less space in the housing.

The butt strap is stamped out of the corresponding spring mounting section, and extends inwardly. The butt strap can be formed on the section before the housing, which consists of a metal band, is bent into its final shape.

Openings are provided in the housing wall for access to the inserted leads. The leads held in the housing can then be removed by relieving the clamping effect of the leaf springs. For example, a screw driver can be inserted into a hole to push the leaf spring off of the lead.

The invention will be discussed in detail hereinbelow with reference to the preferred embodiment and in conjunction with the accompanying drawings.

DETAILED DESCRIPTION OF THE INVENTION

The screw-plug terminal includes a substantially rectangular housing 1, formed from a stamped-out band or strip of conductive material that has been bent through several right angles. In a longitudinal wall 19 of the housing 1, an opening is provided for a threaded pin (not shown). The pin can be screwed into an internally threaded spacer 11. The threaded pin allows a connector to be firmly clamped in the housing.

Figure 2:
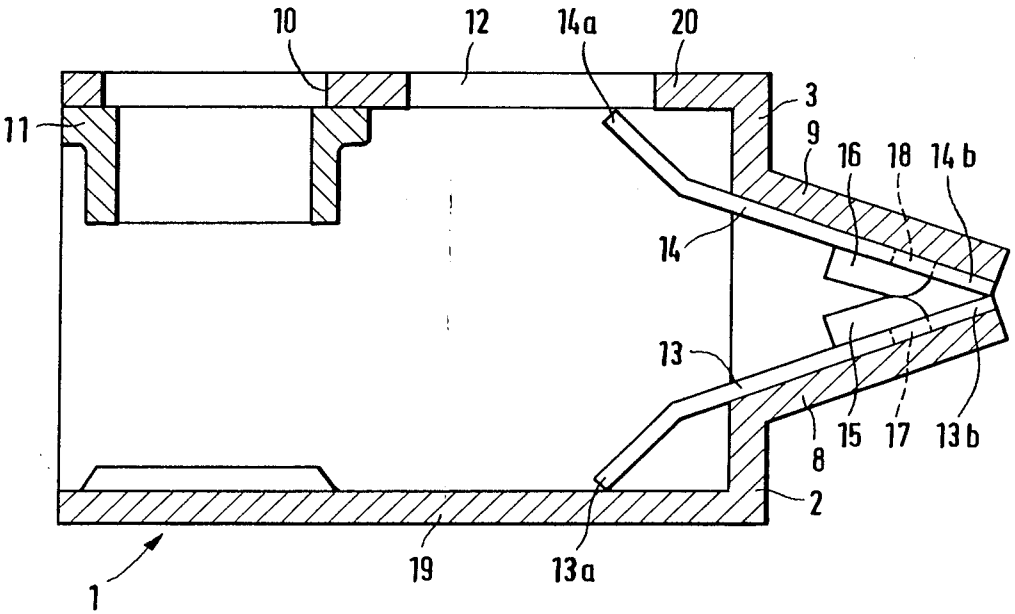
FIG. 2 is a side view of the screw-plug terminal of FIG. 1 partially in section.
Figure 1:
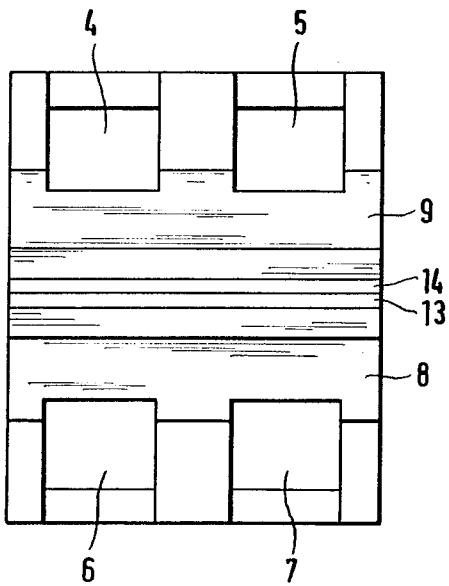
FIG. 1 is a front elevational view of a screw-plug terminal according to the present invention.

The end of the housing, shown on the right in FIG. 2, includes end pieces 2, 3, in which are provided holes 4, 5, 6, and 7 (see FIG. 1) for a corresponding number of principal connecting leads (not shown). The leads are inserted (i.e. plugged) into the housing from the right as viewed in FIG. 2. In order to provide space in the housing for the inserted leads, sections 8, 9 of the end pieces 2, 3 are bent so as to be oriented towards each other in a V-shaped form.

A pair of leaf springs 13, 14 are located inside the housing 1, and extend from the interior of sections 8, 9, respectively, to the interior of the housing adjacent housing walls 19, 20, respectively. The leaf springs each have a long base leg, **13*b* and 14*b* respectively, which are each provided with a rectangular opening, 17 and 18, respectively. Butt straps 15, 16 are stamped out of sections 8, 9, respectively, and extend through respective rectangular openings 17, 18. The butt straps 15, 16 are bent in order to fix the leaf spring base legs 13*b*, 14*b* to the sections 8, 9 in the position shown in FIG. 2. Attached to the long base legs 13*b*, 14*b* are angled end sections 13*a*, 14*a*, respectively, extending into the housing 1. Each section 13*a*, 14*a* extends at an approximate angle of 45° with housing walls 19, 20. Each leaf spring 13, 14 is partially slit in its longitudinal direction. The end sections 13*a*, 14*a* of the leaf springs will then clamp the leads inserted through the holes 4, 5, 6, and 7, each lead being held independently of the others. The leads can be easily detached from the housing 1 via openings 12 provided in the housing walls 19, 20 (only one such opening 12 shown in FIG. 2). A screw driver, for example, is inserted in an opening 12** to push a leaf spring end section away from its position clamping a lead, and the lead can then be removed.

A four-pole screw-plug terminal has been described above. However, it should be understood that the angled spring mounting sections and leaf springs shown on the right hand side of FIG. 2 could also be provided to the left hand side of the housing, so as to form an eight-pole screw-plug terminal, thus enabling eight leads to be detachably mounted.

While a specific embodiment of the invention has been shown and described in detail to illustrate the principles of the invention, it will be understood that the invention may take on other forms and embodiments without departing from such principles.

I claim:

1. A screw-plug terminal for receiving a plurality of leads, comprising:

a housing formed by housing walls and a housing end connected to said housing walls, a plurality of apertures in said housing end for receiving respective individual leads, said housing end including a plurality of end pieces, each said end piece having a spring mounting section extending obliquely and outwardly from said housing;

each said spring mounting section having a leaf spring disposed along an inner surface thereof, each said leaf spring extending from said inner surface of said spring mounting section toward the interior of said housing to a position adjacent one of said housing walls to thereby form means for clamping said respective leads received through said respective apertures against said housing wall; and means for attaching each said leaf spring to said inner surface of said respective spring mounting section.

2. The screw-plug terminal of claim 1, wherein:

said housing is substantially rectangular in shape, and is stamped out of a conducting material.

3. The screw-plug terminal of claim 1, wherein:

said housing end includes two said end pieces and two said spring mounting sections, and comprising two said leaf springs.

4. The screw-plug terminal of claim 3, wherein:

said obliquely and outwardly extending spring mounting sections extend toward each other in a substantially V-shaped configuration.

5. The screw-plug terminal of claim 3, wherein:

said housing end includes four said apertures; and each said leaf spring is partially slit in its longitudinal direction, whereby four said leads can be received and clamped in said housing.

6. The screw-plug terminal of claim 1, wherein:

each said leaf spring has an opening therein along a portion of said leaf spring extending along said inner surface, said opening receiving said means for attaching said leaf spring.

7. The screw-plug terminal of claim 6, wherein:

said means for attaching comprises a butt strap integral with said inner surface.

8. The screw-plug terminal of claim 1, wherein:

each said leaf spring comprises a base leg portion and a free end portion, said base leg portion extending along said inner surface of said respective spring mounting section, and said free end portion extending at an angle from said base leg portion to said position adjacent one of said housing walls.

9. The screw plug terminal of claim 1, wherein:

said housing walls are provided with a plurality of access apertures, each said access aperture positioned so as to allow access to a said leaf spring, whereby a lead clamped by said leaf spring can be released.

* * * * *